US009441587B2

(12) United States Patent
Brown et al.

(10) Patent No.: US 9,441,587 B2
(45) Date of Patent: Sep. 13, 2016

(54) PRESSURE REGULATOR HAVING AN INTEGRATED CHECK VALVE

(71) Applicant: CATERPILLAR INC., Peoria, IL (US)

(72) Inventors: Cory A Brown, Peoria, IL (US); David T Montgomery, Edelstein, IL (US); Mark F Sommars, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 939 days.

(21) Appl. No.: 13/718,516

(22) Filed: Dec. 18, 2012

(65) Prior Publication Data

US 2014/0165966 A1 Jun. 19, 2014

(51) Int. Cl.
*F02M 43/04* (2006.01)
*F02M 63/00* (2006.01)

(52) U.S. Cl.
CPC ..... *F02M 43/04* (2013.01); *F02M 63/0042* (2013.01); *F02M 63/0052* (2013.01); *Y10T 137/0379* (2015.04); *Y10T 137/7794* (2015.04)

(58) Field of Classification Search
CPC ..... F02M 43/04; F02M 63/0042; F02M 63/0052; Y10T 137/7794; Y10T 137/0379
USPC ..... 123/457; 137/12, 505.11
See application file for complete search history.

(56) References Cited

U.S. PATENT DOCUMENTS 2,445,544 A 7/1948 Trautman
3,604,446 A 9/1971 Brooks
3,989,060 A 11/1976 Hughes
RE30,261 E 4/1980 Brand
4,535,728 A * 8/1985 Batchelor ..... F02B 43/00 123/27 GE
4,614,168 A * 9/1986 Batchelor ..... F02B 43/00 123/27 GE
4,896,691 A * 1/1990 Green ..... G05D 23/1313 137/100
5,271,428 A * 12/1993 Dunn ..... G05D 16/18 137/509
6,026,787 A * 2/2000 Sun ..... F02D 19/0647 123/525
6,062,245 A * 5/2000 Berglind ..... G05D 16/0655 137/12
7,870,869 B2 1/2011 Larsen
8,167,001 B2 5/2012 Larsen
8,342,201 B2 * 1/2013 Nitta ..... G05D 16/0669 137/505.11
2002/0073976 A1 * 6/2002 Leung ..... F02M 23/00 123/533
2005/0252555 A1 11/2005 Browne et al.
2010/0071363 A1 * 3/2010 Ridgway ..... F02B 37/00 60/598
2011/0179946 A1 7/2011 Walsh et al.

FOREIGN PATENT DOCUMENTS

EP 2143916 A1 1/2010

* cited by examiner

*Primary Examiner* — Hieu T Vo
*Assistant Examiner* — Arnold Castro
(74) *Attorney, Agent, or Firm* — Finnegan, Henderson, Farabow, Garrett & Dunner, LLP

(57) ABSTRACT

A pressure regulator for use in an engine is disclosed. The pressure regulator may include first and second flow paths formed in a body, wherein the first flow path is configured to pass a first fluid and the second flow path is configured to receive a second fluid. A diaphragm may be disposed within the first flow path and the diaphragm may be configured to move based on a pressure differential between the first and second fluids. The pressure regulator may further include a seat associated with the first flow path. A primary valve element may be connected to the diaphragm and configured to selectively engage the seat when a pressure of the fluid in the first flow path exceeds a pressure of the fluid in the second flow path by a first threshold amount. Additionally, a secondary valve element may be connected to the diaphragm and configured to selectively engage the seat when the pressure of the fluid in the second flow path exceeds the pressure of the fluid in the first flow path by a second threshold amount.

13 Claims, 4 Drawing Sheets

PRESSURE REGULATOR HAVING AN INTEGRATED CHECK VALVE

TECHNICAL FIELD

The present disclosure is directed to a pressure regulator, and more particularly, to a pressure regulator having an integrated check valve.

BACKGROUND

Dual fuel vehicles generally include a fuel system having an internal combustion engine that can run on either gas or diesel fuel. Such fuel systems have an injector to pump both fuels to the engine from a gas supply and a diesel supply. However, gas pressure is required to be regulated relative to diesel pressure in order to properly maintain and run the engine. A regulator is used to control such relative pressures.

Dome loaded regulators are well known in the art and generally include a dome space, a gas flow path having an inlet and outlet, a spring-biased seat, and a diaphragm. When gas pressure decreases from a desired pressure, compared to the diesel pressure, the diaphragm moves away from the dome space and toward the spring-biased seat. This movement widens the gas flow path between the inlet and the outlet, thereby increasing the flow rate and corresponding pressure. After the gas pressure is restored to a normal pressure, compared to the diesel pressure, the bias of the diaphragm causes it to move back to its original position. When the gas pressure increases from the desired pressure, the diaphragm moves away from the spring-biased seat and thus decreases the gas flow rate. This restores a normal pressure of gas in the regulator, compared to the diesel pressure, and also returns the diaphragm to its original position. An exemplary regulator is described in U.S. Pat. No. 8,167,001 that issued to Larsen on May 1, 2012 (the '001 patent).

Although traditional regulators, including the regulator described in the '001 patent, may adequately control the relative pressures of diesel and gas in a normal mode, they may not function properly during a failure condition. Specifically, when a gas fuel leak occurs in the fuel system of the '001 patent and the gas pressure falls, the traditional regulator may widen the gas flow path and feed more gas fuel into the leak. Similarly, if all the gas fuel in the fuel system has been exhausted, the traditional regulator will again widen the gas flow path, even though no more gas fuel is available to be pumped to the engine.

The disclosed pressure regulator is directed to overcoming one or more of the problems set forth above and/or other problems of the prior art.

SUMMARY OF THE INVENTION

In one aspect, the present disclosure is directed to a pressure regulator. The pressure regulator may include a body, a first flow path formed in the body and configured to pass a first fluid, and a second flow path formed in the body and configured to receive a second fluid. The pressure regulator may also include a diaphragm disposed within the first flow path and configured to move based on a pressure differential between the first and second fluids. The pressure regulator may further include a seat associated with the first flow path and a primary valve element connected to the diaphragm and configured to selectively engage the seat when a pressure of the first fluid exceeds a pressure of the second fluid by a first threshold amount. Additionally, the pressure regulator may include a secondary valve element connected to the diaphragm and configured to selectively engage the seat when the pressure of the second fluid exceeds the pressure of the first fluid by a second threshold amount.

In another aspect, the present disclosure is directed to a method of regulating fuel pressures. The method may include directing a first fluid into a first flow path of a regulator and directing a second fluid into a second flow path of the regulator. The method may further include selectively restricting the first flow path when a pressure of the first fluid exceeds a pressure of the second fluid by a first threshold amount, and selectively inhibiting flow through the first flow path when the pressure of the second fluid exceeds the pressure of the first fluid by a second threshold amount.

DETAILED DESCRIPTION

Figure 1:
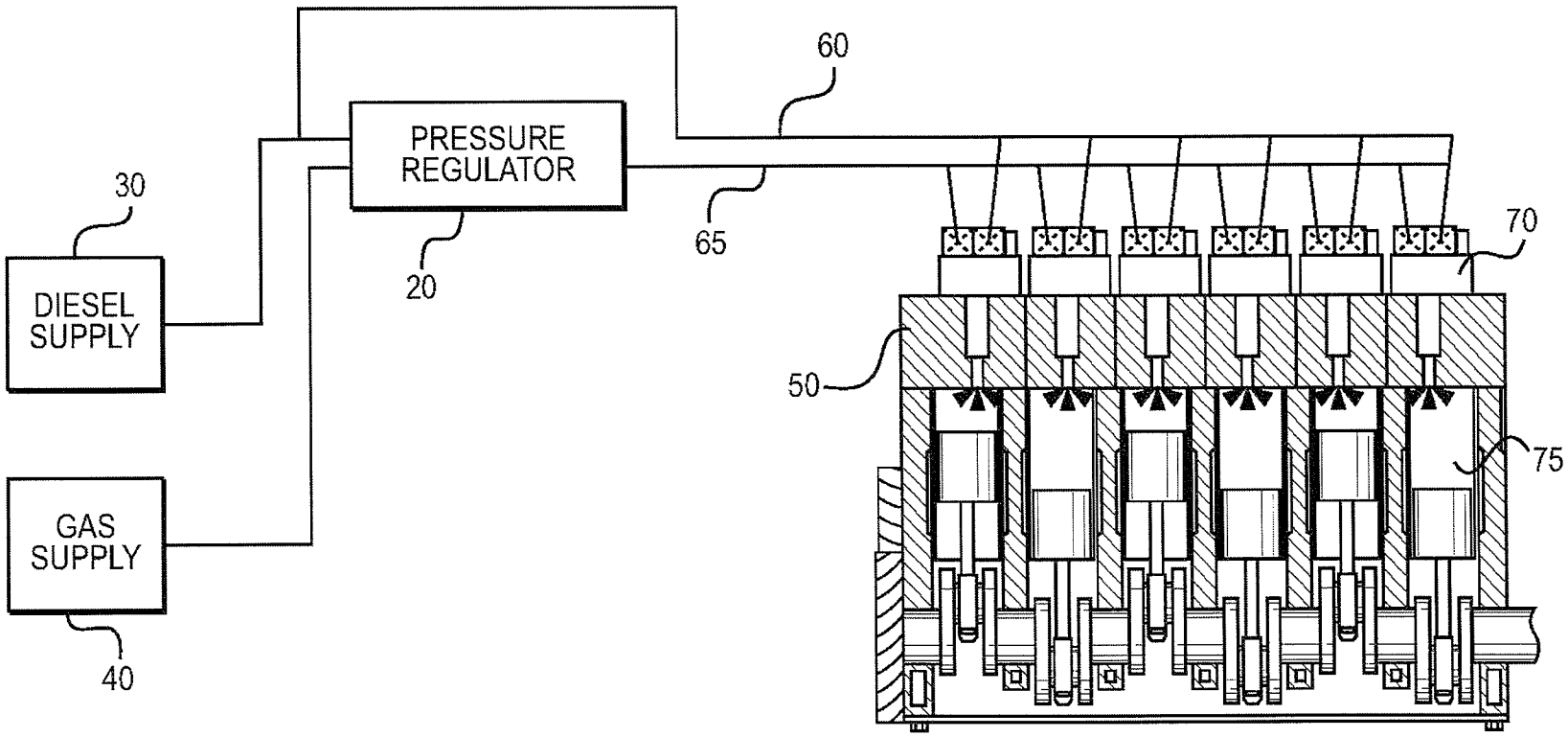
FIG. 1 is a schematic illustration of an exemplary disclosed fuel system.

FIG. 1. illustrates an exemplary disclosed fuel system 10 having a pressure regulator 20. The fuel system 10 may be used to pump fuel into an engine 50 of a machine, and may be either mechanically or electronically controlled. The machine may be a mobile or stationary machine. As shown in FIG. 1, the pressure regulator 20 may connect a first fluid supply 40 (a supply of gaseous fuel) and a second fluid supply 30 (a supply of diesel fuel) with the engine 50 through fuel lines 60 and 65, respectively. Therefore, the fuel lines 60,65 may provide for fluid communication between the pressure regulator 20, first fluid supply 40, second fluid supply 30, and engine 50. The present disclosure embodies the use of fluids other than just gaseous and diesel fuel.

Engine 50 may be a compression ignition-type internal combustion engine with a plurality of cylinders 75. At least one injector 70 may be provided for each cylinder 75, and the fuel lines 60, 65 may connect to each injector 70 in parallel. Therefore, the injectors 70 may be in fluid communication with the pressure regulator 20 and may all be activated simultaneously. Alternatively, each injector 70 may be activated individually, when its corresponding cylinder 75 is near the top of its compression stroke.

Figure 2:
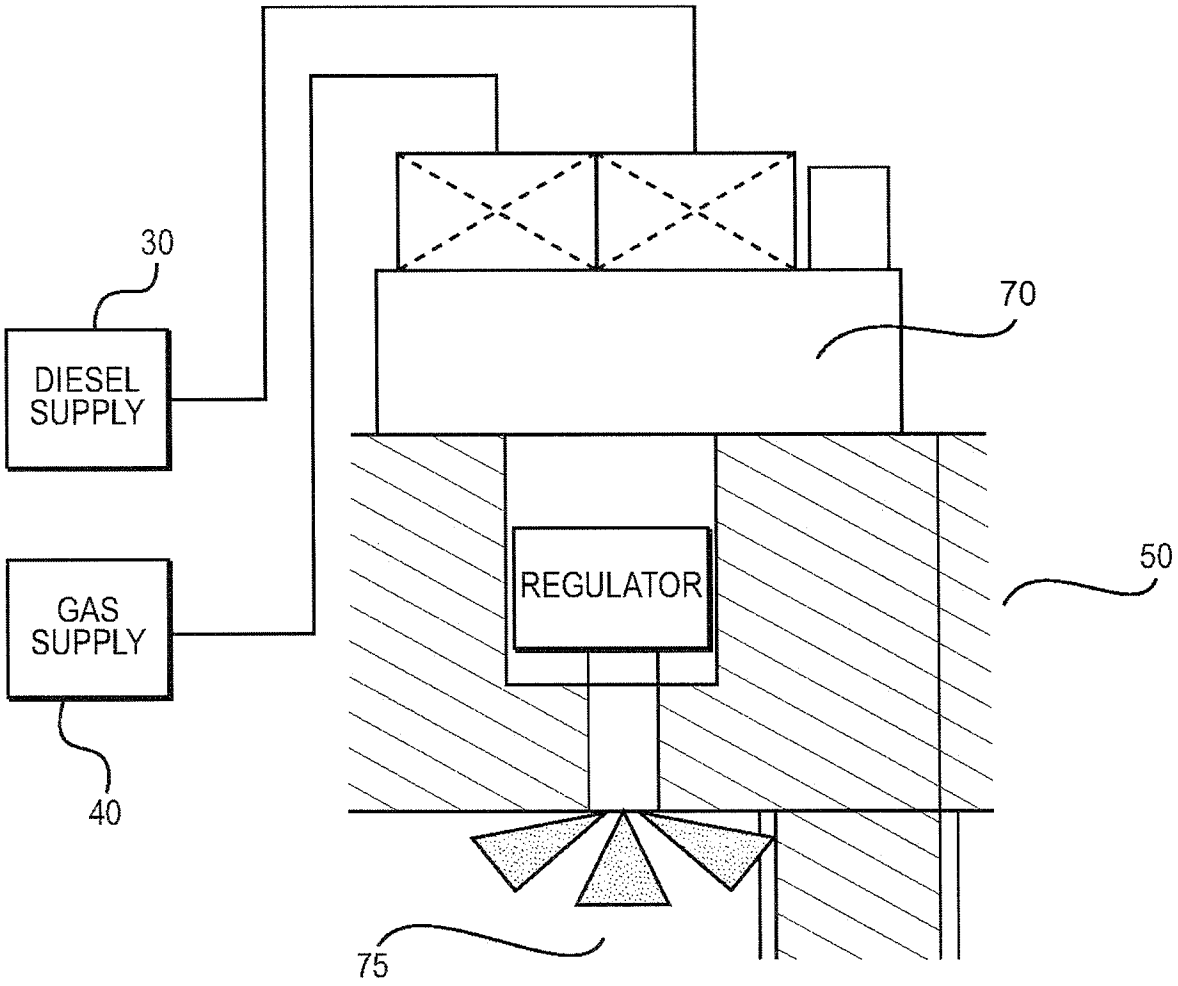
FIG. 2. is a schematic and diagrammatic illustration of another exemplary disclosed fuel system.

In one exemplary embodiment, the pressure regulator 20 may be located external to the injectors 70. FIG. 1 shows the pressure regulator 20 as located upstream of the engine 50 and injectors 70. Alternatively, as shown in FIG. 2, the pressure regulator 20 may be disposed within each injector 70.

Figure 3:
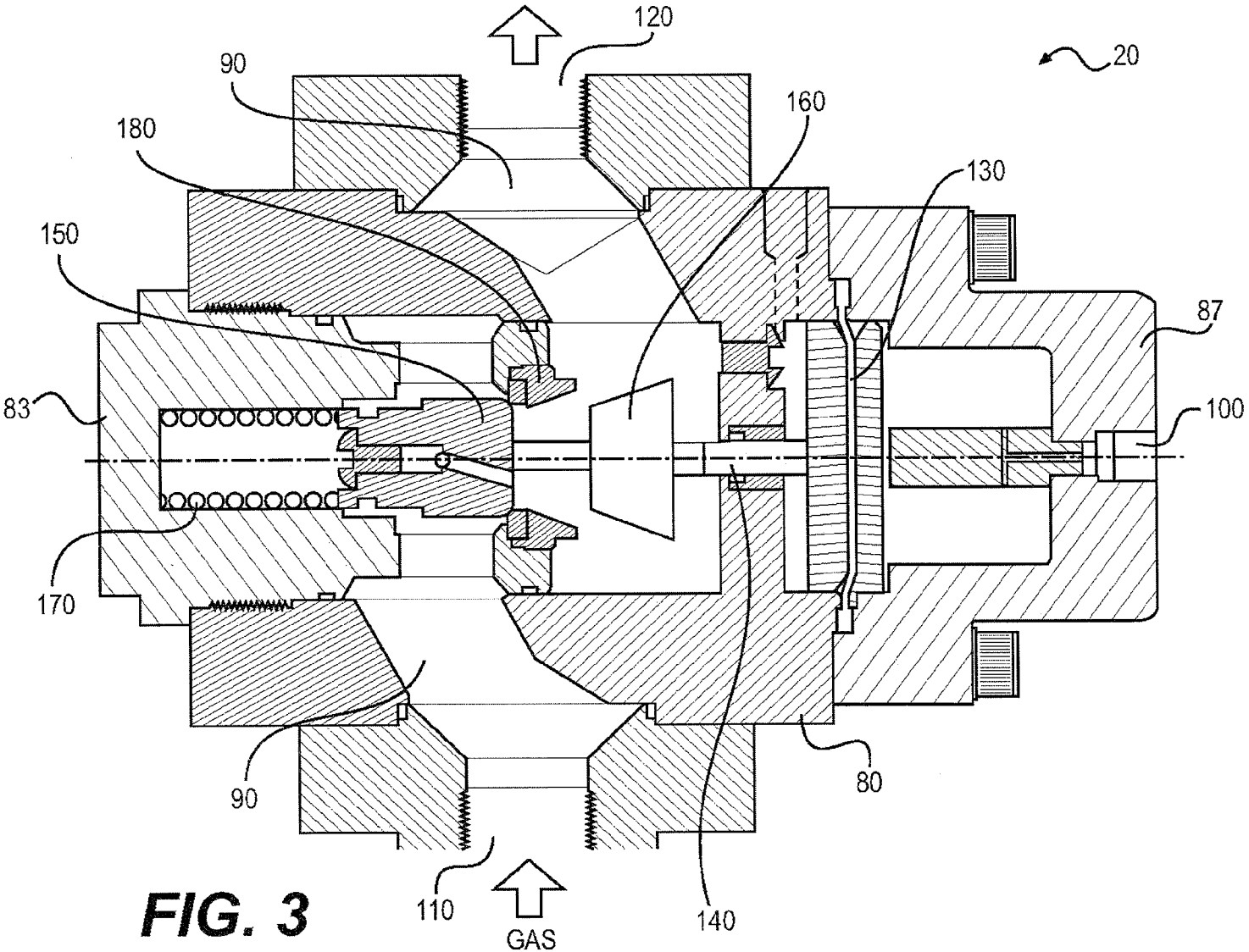
FIG. 3 is a cross-sectional illustration of a pressure regulator that may be used in conjunction with the fuel systems of FIG. 1 and FIG. 2.

FIG. 3 shows the pressure regulator 20 in a first mode of operation. The pressure regulator 20 may include a body 80 having first and second ends 83 and 87, respectively. A first flow path 90 and a second flow path 100 may be disposed in the body 80, between the first and second ends 83, 87. The first flow path 90 may include an inlet 110 and an outlet 120 and be configured to pass gaseous fuel. Therefore, the gaseous fuel may be directed from first fluid supply 40, through the inlet 110 and the outlet 120, before it reaches engine 50. The second flow path 100 may be configured to receive diesel fuel from second fluid supply 30.

The gaseous and diesel fuels, in the first and second flow paths 90, 100, may both have a pressure of about 40 MPa when the engine 50 is in a steady state. However, the pressure of the gaseous fuel may periodically exceed the pressure of the diesel fuel, or vice versa, creating a pressure differential between the first and second flow paths 90, 100.

The pressure regulator 20 may further include a diaphragm 130 slidably moveable between the first and second ends 83, 87 and disposed between the first and second flow paths 90, 100. Diaphragm 130 may be directly connected to a primary valve element 150 and a secondary valve element 160 through a rod 140. Therefore, movement of the diaphragm 130 may also cause corresponding movement of the rod 140, the primary valve element 150, and the secondary valve element 160. The diaphragm 130 may be configured to move based on the pressure differential between the first and second flow paths 90, 100 to increase or decrease an area of the first flow path 90. Specifically, the diaphragm 130 may be configured to move toward the first end 83 or the second end 87 based on the pressure of the fuels in the first and second flow paths 90, 100.

When the pressure of the gaseous fuel in the first flow path 90 exceeds the pressure of the diesel fuel in the second flow path 100 by a first threshold amount, the diaphragm 130 may move to the right toward the second end 87. Such movement of the diaphragm 130 may cause the rod 140 and the primary valve element 150 to also move to the right toward the second end 87. Movement of the primary valve element 150 towards the second end 87 may decrease the area of the first flow path 90 (i.e. restricting flow through the first flow path 90), allowing less gaseous fuel to flow through the first flow path 90. The primary valve element 150 may eventually engage a first side of a seat 180 when it has moved a sufficient distance, as shown in FIG. 3. Therefore, the primary valve element 150 may be configured to selectively engage the seat 180 when a pressure of the gaseous fuel exceeds a pressure of the diesel fuel by the first threshold amount. This engagement may inhibit flow through the first flow path 90.

Figure 4:
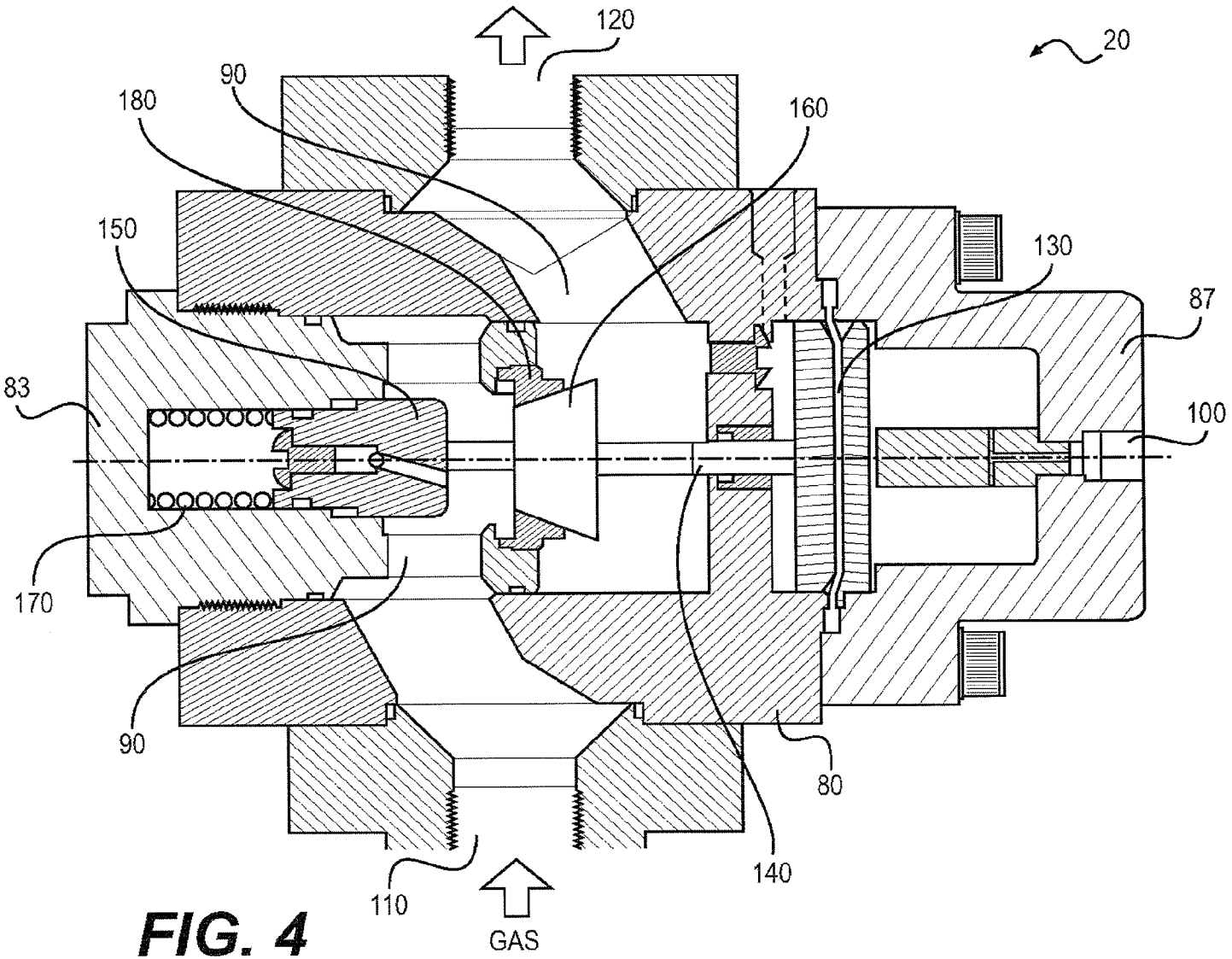
FIG. 4 is another cross-sectional illustration of the pressure regulator of FIG. 3.

When the pressure of the diesel fuel in the second flow path 100 exceeds the pressure of the gaseous fuel in the first flow path 90, the diaphragm 130 may move to the left toward the first end 83. Such movement of the diaphragm 130 may cause the primary valve element 150 to also move to the left toward the first end 83 (FIG. 4). The primary valve element 150 may disengage the seat 180 and increase the area of the first flow path 90, allowing more gaseous fuel to flow within. The diaphragm 130 may be configured to constantly move within body 80 to substantially balance the gaseous and diesel fuel pressures. The rod 140 and primary valve element 150 may constantly move with the diaphragm 130 and continuously increase or decrease the area of the first flow path 90.

In some embodiments it may be desirable to maintain an offset between gaseous and diesel fuel pressures, for example, an offset of about 5 MPa. In these situations, diaphragm 130 may be biased, for example by a spring 170, in one direction or another. As shown in FIG. 3, spring 170 may be configured to bias the diaphragm 130 toward second end 87, so that the force of the spring 170 may cause the offset between the gaseous and diesel fuel pressures. The diaphragm 130 must overcome the force of the spring 170 and the gaseous fuel pressure to move toward first end 83 and increase the area of the first flow path 90. A greater diesel fuel pressure, compared to the pressure of the gaseous fuel and spring force, may be sufficient to move the diaphragm 130 toward first end 83.

When the pressure of the gaseous fuel in the first flow path 90 has reduced substantially, the fuel system 10 may be caused to operate in a limp home mode. This situation may occur, for example during a failure condition, such as a leak in fuel line 65 between pressure regulator 20 and injectors 70. Other failure conditions may include wherein the engine 50 consumes its entire supply of gaseous fuel, the engine 50 has exhausted an LNG supply, a failure occurs in an LNG pump, a pressure sensor faults, or the injector (70) faults. In any of these situations, the gaseous fuel pressure may be reduced substantially in the first flow path 90. When this happens, the pressure of the diesel fuel in the second flow path 100 may exceed the pressure of the gaseous fuel in the first flow path 90 by a second threshold amount.

When the pressure of the diesel fuel in the second flow path 100 exceeds the pressure of the gaseous fuel in the first flow path 90 by the second threshold amount, this pressure differential may cause the diaphragm 130 to move all the way to the left, towards the first end 83, and increase the area of the first flow path 90. Because the diaphragm 130 is connected to the rod 140 and secondary valve element 160, movement of the diaphragm 130 to the left may also cause the rod 140 and secondary valve element 160 to move to the left, as shown in FIG. 4. The secondary valve element 160 may be configured to selectively engage a second side (e.g. a back side) of the seat 180. This selective engagement may cause the secondary valve element 150 to block the first flow path 90 and inhibit the flow of the gaseous fuel through the first flow path 90. The fuel system 10 may still pump the diesel fuel to the engine 50 during this situation, allowing the engine 50 to run on the diesel fuel alone. Therefore, the diesel fuel may flow directly to the engine 50 regardless of regulator operation.

The engagement of the secondary valve element 160 with the back side of seat 180 may also inhibit movement of the diesel fuel into the first flow path 90. Any diesel fuel that has migrated from the injectors 70, through outlet 120, and into the first flow path 90 may be substantially blocked from upstream movement by the secondary valve element 160.

Seat 180 may be disposed within the first flow path 90 and shaped to form an interference fit with the primary valve element 150 and the secondary valve element 160. For example, the seat 180 and primary valve element 150 may be configured to form a seal that inhibits movement of the gaseous fuel past the primary valve element 150 and into the outlet 120. Likewise, the seat 180 and secondary valve element 160 may be configured to form a seal that inhibits movement of the gaseous fuel past the secondary valve element 160 and into the outlet 120. Additionally, the seal between the seat 180 and secondary valve element 160 may inhibit movement of the diesel fuel past the secondary valve element 160 and into the inlet 110 of the first flow path 90.

INDUSTRIAL APPLICABILITY

The disclosed pressure regulator 20 may effectively inhibit gaseous fuel flow during the limp home mode of operation, allowing the engine 50 to run on diesel alone. Specifically, the pressure regulator 20 may utilize an integrated check valve (i.e. secondary valve element 160) to seal the gaseous fuel flow path. Operation of the fuel system 10 will now be described in detail.

Under normal operating conditions, two different fuels may be pumped to the engine 50 via fuel lines 60, 65. In one exemplary embodiment, the first fuel is natural gas and may be pumped into the engine 50 from gas supply 40, and the second fuel is diesel fuel and may be pumped into the engine 50 from diesel supply 30. Only the natural gas may pass through pressure regulator 20 before entering the engine 50, while the diesel fuel may be pumped directly from the diesel supply 30 into the engine 50. The pressure of the diesel fuel, however, may be used to regulate the pressure of the natural gas. The natural gas may directed into the first flow path 90 and the diesel fuel may be directed into the second flow path 100 of pressure regulator 20.

The pressure regulator 20 may substantially balance the pressures of the natural gas and diesel fuel in their respective first and second flow paths 90, 100. Specifically, diaphragm 130 may slidably move within body 80 to adjust for any difference in pressures. When the natural gas pressure exceeds the diesel fuel pressure by a first threshold amount, the diaphragm 130 may move to the right towards second end 87, as shown in FIG. 3, until the primary valve element 150 sufficiently decreases the area of the first flow path 90. Further movement of the primary valve element 150 may result in engagement with seat 180. This engagement may inhibit the flow of natural gas within the first flow path 90. The pressure of the natural gas may then decrease, until it is substantially equal to or less than the diesel fuel pressure. At this time, the diaphragm 130 may disengage the seat 180, return left towards first end 83, thereby increasing the area of the first flow path 90. More natural gas may then be able to flow through the first flow path 90.

The diaphragm 130 may constantly move from left to right, as shown in FIGS. 3 and 4, to regulate the natural gas pressure relative to the diesel fuel pressure. Variance in natural gas pressure relative to diesel pressure may move the diaphragm 130, if sufficient to overcome the bias of spring 170. As shown in FIG. 3, spring 170 may naturally bias the primary valve element 150 to the right to maintain a desired offset of about 5 MPa between the fuel pressures.

During a failure condition, a natural gas leak may occur in the fuel system 10 at a location downstream of pressure regulator 20. When this happens, the natural gas may leak into the atmosphere instead of flowing into engine 50. This may cause a significant drop in natural gas pressure relative to diesel fuel pressure within the pressure regulator 20. In other failure conditions, including but not limited to wherein the engine 50 consumes its entire supply of gaseous fuel, the engine 50 has exhausted an LNG supply, a failure occurs in an LNG pump, a pressure sensor faults, or the injector (70) faults, all of the natural gas may be consumed by the engine 50 and the gas supply 40 may be exhausted. The natural gas pressure may drop significantly relative to the diesel fuel pressure within the pressure regulator 20.

When the fuel system 10 is substantially depleted of natural gas, engine 50 may still be able to run in the limp home mode on diesel fuel only. Due to the decrease of gas pressure, the diaphragm 130 may still move to the left toward first end 83 to increase the area of the first flow path 90. During limp home mode of operation, however, secondary valve element 160 may move with the diaphragm 130 and act as a check valve to inhibit flow through first flow path 90. Specifically, the secondary valve element 160 may engage the back end of seat 180, within the first flow path 90, to selectively block the first flow path 90. This may help to prevent uncontrolled natural gas flow within the first flow path 90, yet still allow the engine 50 to run on diesel fuel alone.

Additionally, the seal formed between the secondary valve element 160 and seat 180 may inhibit any diesel fuel from migrating into the inlet 110 of the first flow path 90. Diesel fuel may inadvertently migrate from the injectors (70) and into the first flow path 90 when the diesel fuel pressure is much higher than the gaseous fuel pressure (e.g. during limp home mode). The secondary valve element 160 and seat 180 may block the diesel fuel from entering the inlet 110 and trap the diesel fuel within the first flow path 90. When the fuel system 10 exits limp home mode, the tapped diesel fuel may then exit the first flow path 90 through outlet 120 and be injected into the engine 50.

The fuel system 10 of the present disclosure may provide a compact system that allows for efficient use during limp home mode operation. The secondary valve element 160, being located within the pressure regulator 20 (see the embodiment of FIGS. 3 and 4), may help reduce the overall size of the fuel system 10. Additionally, the pressure regulator 20 itself may be disposed within the injector 70 (see the embodiment of FIG. 2), and thereby further compact the fuel system 10. The secondary valve element 160 may provide check functionality and prohibit diesel fuel from migrating backwards into the inlet 110. This may help to prevent damage to the gas supply 40 from overpressurization due to a build-up of diesel in the gas supply. Additionally, the check functionality may inhibit natural gas from being pumped into engine 50 during the limp home mode. Therefore, the engine 50 may run on diesel fuel alone and reduce any waste of gaseous fuel to the atmosphere.

It will be apparent to those skilled in the art that various modifications and variations can be made to the pressure regulator and fuel system of the present disclosure. Other embodiments of the system will be apparent to those skilled in the art from consideration of the specification and practice of the pressure regulator and fuel system disclosed herein. It is intended that the specification and examples be considered as exemplary only, with a true scope of the disclosure being indicated by the following claims and their equivalents.

What is claimed is:

1. A pressure regulator, comprising:

a body;

a first flow path formed in the body and configured to pass a first fluid;

a second flow path formed in the body and configured to receive a second fluid;

a diaphragm disposed within the first flow path and configured to move based on a pressure differential between the first and second fluids;

a seat associated with the first flow path;

a primary valve element connected to the diaphragm and configured to selectively engage the seat when a pressure of the first fluid exceeds a pressure of the second fluid by a first threshold amount; and a secondary valve element connected to the diaphragm and configured to selectively engage the seat when the pressure of the second fluid exceeds the pressure of the first fluid by a second threshold amount.

2. The pressure regulator of claim 1, wherein movement of the diaphragm increases or decreases an area of the first flow path.

3. The pressure regulator of claim 1, wherein the seat is configured to form an interference fit with each of the primary and secondary valve elements.

4. The pressure regulator of claim 3, wherein the primary valve element is configured to engage a first side of the seat and the secondary valve element is configured to engage a second side of the seat to form the interference fit.

5. The pressure regulator of claim 4, wherein:

the first flow path includes an inlet and an outlet; and engagement of the primary valve element with the seat restricts movement of the first fluid from the inlet into the outlet.

6. The pressure regulator of claim 5, wherein engagement of the secondary valve element with the seat restricts movement of the second fluid into the inlet.

7. The pressure regulator of claim 1, further including a spring configured to bias the primary valve element and maintain an offset between the first and second fluid pressures.

8. The pressure regulator of claim 1, wherein the first fluid is a gaseous fuel and the second fluid is diesel fuel.

9. The pressure regulator of claim 8, wherein the diesel fuel flows directly to an engine regardless of regulator operation.

10. The pressure regulator of claim 8, wherein only the diesel fuel flows to an engine when the secondary valve element and seat are engaged.

11. A fuel system for an engine, comprising:

a gaseous fuel supply;

a diesel fuel supply;

an injector;

a pressure regulator in communication with the injector, the gaseous fuel supply, and the diesel fuel supply;

wherein the pressure regulator includes:

a body;

a first flow path formed in the body and configured to pass gaseous fuel;

a second flow path formed in the body and configured to receive diesel fuel;

a diaphragm disposed within the first flow path and configured to move based on a pressure differential between the gaseous and diesel fuels;

a seat disposed with the first flow path;

a primary valve element connected to the diaphragm and configured to selectively engage a first side of the seat when a pressure of the gaseous fuel exceeds a pressure of the diesel fuel by a first threshold amount; and a secondary valve element connected to the diaphragm and configured to selectively engage a second side of the seat when the pressure of the diesel fuel exceeds the pressure of the gaseous fuel by a second threshold amount.

12. The fuel system of claim 11, wherein:

the first flow path includes an inlet and an outlet; and engagement of the primary valve element with the seat restricts movement of the gaseous fuel from the inlet into the outlet, and engagement of the secondary valve element with the seat restricts movement of the diesel fuel into the inlet.

13. The fuel system claim 11, wherein the pressure regulator is disposed inside the injector.

* * * * *